US005838880A

United States Patent [19]

Brooks, Jr. et al.

[11] Patent Number: 5,838,880

[45] Date of Patent: Nov. 17, 1998

[54] GROUND HEATING SYSTEM

[75] Inventors: Richard Edgar Brooks, Jr., Chassell, Mich.; Mark Bruckelmyer, Duluth, Minn.

[73] Assignee: Ground Heaters, Inc., Spring Lake, Mich.

[21] Appl. No.: 585,510

[22] Filed: Jan. 16, 1996

[51] Int. Cl.[6] ..... F24H 1/10; F28D 3/00

[52] U.S. Cl. ..... 392/485; 392/487; 392/488; 392/473; 126/343.5 A; 222/146.5; 165/45; 239/130; 239/131; 404/131

[58] Field of Search ..... 392/485, 487, 392/488, 473; 126/343.5 A; 222/146.5; 165/45; 239/130, 131; 405/131

[56] References Cited

U.S. PATENT DOCUMENTS

| | | | |
|---|---|---|---|
| 340,161 | 4/1886 | Sooysmith . | |
| 879,745 | 2/1908 | Cooper . | |
| 1,390,457 | 9/1921 | Moran . | |
| 1,587,984 | 6/1926 | Pearce . | |
| 1,704,577 | 3/1929 | Pomykala . | |
| 1,828,989 | 10/1931 | Wade . | |
| 2,617,597 | 11/1952 | Bonilla . | |
| 3,293,863 | 12/1966 | Cox et al. . | |
| 3,699,685 | 10/1972 | Scott . | |
| 3,762,171 | 10/1973 | Bjorheim et al. . | |
| 4,094,151 | 6/1978 | Fujita et al. . | |
| 4,120,157 | 10/1978 | Tang | 60/618 |
| 4,275,705 | 6/1981 | Schaus et al. . | |
| 4,359,187 | 11/1982 | Moore . | |
| 4,448,348 | 5/1984 | Bidwell . | |
| 4,484,564 | 11/1984 | Erickson . | |
| 4,593,753 | 6/1986 | McConnell | 165/51 |
| 4,617,989 | 10/1986 | Seat . | |
| 4,671,701 | 6/1987 | Elliott . | |
| 4,676,695 | 6/1987 | Duthweiler . | |
| 4,982,788 | 1/1991 | Donnelly | 405/131 X |
| 4,986,311 | 1/1991 | Mikkelson . | |
| 5,181,655 | 1/1993 | Bruckelmyer | 237/1 R |
| 5,181,796 | 1/1993 | DeYoung | 405/131 X |
| 5,244,310 | 9/1993 | Johnson . | |
| 5,366,308 | 11/1994 | Crispino | 126/343.5 A X |
| 5,449,113 | 9/1995 | Bruckelmyer | 405/131 X |
| 5,482,402 | 1/1996 | Nelson | 405/131 X |

*Primary Examiner*—Peter S. Wong
*Assistant Examiner*—K. Shin
*Attorney, Agent, or Firm*—Michael A. Mohr

[57] ABSTRACT

A ground heating system is provided comprising an internal combustion engine which has a shaft output and an exhaust gas stream. An electric alternator/generator is driven by the shaft output of the engine. A working fluid is provided for transferring heat to the ground. A heat exchanger receives the exhaust gas from the internal combustion engine and transfers waste heat from the exhaust gas to the working fluid. An electric heating element is provided for converting some of the electric output of the generator into heat and transferring this heat to the working fluid. A pump circulates the working fluid through a ground-engaging heat exchanger.

21 Claims, 8 Drawing Sheets

GROUND HEATING SYSTEM

BACKGROUND OF THE INVENTION

1. Field of the Invention

The present invention relates to ground heating or thawing systems in general and, more particularly, relates to such a system which is driven by the waste heat and shaft horsepower from an internal combustion engine.

2. Description of the Related Art

In northern climates, frozen ground is a problem for the construction industry during the winter months. Cold winter temperatures can cause water and sewer pipes to freeze. Frozen ground also interferes with any earth moving operation such as trenching, excavating for foundation footings, leveling for a concrete slab, or digging a gravesite. Further, after concrete footings and a slab are poured, there is a need for heat to properly cure the concrete. Once a building shell is erected, heat is needed to elevate temperatures within the unfinished structure for the protection of workmen and for curing or drying finishing processes that take place inside the building shell. Consequently, in northern climates, mobile ground heating or thawing systems are known.

One common type of mobile heating system known in the prior art comprises a kerosine burner and a fan for discharging large volumes of heated air into a temporary enclosure which confines the heated air above the area which is to be thawed. Such systems are also used to blow heated air into an unfinished structure during later phases of construction. However, when such systems are used in this latter application, they are found to have a significant problem with water vapor, carbon dioxide, and other combustion products, which build up inside the unfinished structure. It is not desirable to expose workmen for many hours to the combustion products which emanate from such devices. Further, since water vapor is one of the principal byproducts of combustion, condensation of the water vapor in the structure can be a problem in cold weather. Such systems are also known to have a low thermal efficiency and are expensive to run because of high fuel consumption.

In another type of mobile ground heating or thawing system, a boiler, a pump and a ground heat exchanger in the form of a hose, including a plurality of ground-engaging probes, are all filled with a heat transfer fluid. The heat transfer fluid is pumped from the boiler through the hose the probes for the purpose of transferring heat to the ground or to a structure. Systems which use such a fluid coupling between the ground and a boiler are known to have better heat transfer efficiency than those employing a burner and a fan. Such systems also provide the advantage of being able to more precisely apply heat to a desired area. In such systems, heat is applied to the ground with fluid-filled rods, which are inserted into holes which are drilled into the frozen ground, or with fluid-filled hoses which are laid over the ground and covered with a suitable quantity of sand and/or other insulating materials.

Ground heating systems which have fluid-filled rods or hoses are also very useful in the construction industry since it is known that the hose from such systems can be disposed under the proposed footings and slab. When footings and slab are poured over the hose, which is embedded in the earth thereunder, the mobile heating system is used to continue to heat the footings, slab, and the shell of the building erected thereover. This provides a steady, clean, dry supply of heat to the structure that does not endanger workmen by exposing them to combustion products. Also, the clean, dry heat does not frustrate other construction processes such as painting and plastering by discharging large quantities of moisture-laden air into the structure. It is also common on a construction site, in a rural area, for there to be a need for a portable electric generator to support the work on the site.

SUMMARY OF THE INVENTION

According to the present invention, these and other problems in the prior art are resolved by provision of an improved ground thawing or heating system of the type which uses a fluid connection and a ground-engaging heat exchanger. More particularly, a ground heating system is provided which comprises an internal combustion engine disposed on a mobile trailer. The internal combustion engine provides both a shaft output and an exhaust gas stream. The internal combustion engine is coupled to an electric alternator/generator which is driven by the shaft output of the internal combustion engine, the electric alternator/generator provides an electric output which can be put to a variety of uses. A working fluid is provided for transferring heat to the ground. An exhaust gas/fluid heat exchanger receives the exhaust gas stream from the internal combustion engine for extracting waste heat from the exhaust gas stream and transferring it to the working fluid of the ground heating system. A ground-engaging heat exchanger, such as a surface-laid hose and/or a plurality of ground-engaging probes, is provided and a pump is provided for circulating the working fluid between the exhaust gas heat exchanger and the ground-engaging heat exchanger. An electric heating element is provided in the fluid side of the exhaust gas heat exchanger for converting some of the electrical output of the alternator/generator directly into heat and transferring this heat to the working fluid. Thus, the shaft output of the engine and the waste heat in the exhaust gas of the engine are converted into heat which is transferred to the working fluid of the ground heating system. This provides a mobile heating system with a high overall thermal efficiency.

According to another aspect of the present invention, the exhaust gas heat exchanger comprises a disc-shaped chamber for receiving the exhaust gas from the internal combustion engine. The disc-shaped chamber is provided with axial and radial directions extending from the center of the chamber, and the disc-shaped chamber is provided with a radial dimension that is larger than the axial dimension of the chamber. An exhaust gas inlet for the disc-shaped chamber is provided which is tangential to the periphery of the disc-shaped chamber. A pair of axially-oriented exhaust gas outlets are provided on opposing sides at the center of the disc-shaped chamber. Whereby exhaust gas flows into the disc-shaped chamber tangentially at the periphery of the chamber and then spirals inwardly to exit from the axially-opposed exhaust gas outlets. A water jacket encompasses this disc-shaped chamber and an electric heating element. The electric heating element is driven by the electrical output of the alternator/generator. The electric heating element is in direct contact with the working fluid, which is pumped through the water jacket and the ground-engaging heat exchanger by an electric pump powered by the electric alternator/generator.

In the ground heating system of the present invention, the high thermal efficiency of fluid ground thawing systems is maintained with the added convenience of using an internal combustion engine as a primary source of heat and a prime mover for an alternator or a generator. The alternator/generator provides a constant speed and constant load for the internal combustion engine. This provides an engine which operates at a predetermined design load and speed which is much more efficient than that normally expected from internal combustion engines, which are normally designed for variable speeds and loads. Further, the loading of the internal combustion engine with the generator increases the exhaust heat output of the internal combustion engine, raising the temperature differential over the exhaust gas heat exchanger and increasing the heat output of the system. Advantageously, such a system also provides a convenient source of electrical power for driving or facilitating other construction processes underway at the site.

DESCRIPTION OF THE PREFERRED EMBODIMENTS

Figure 1:
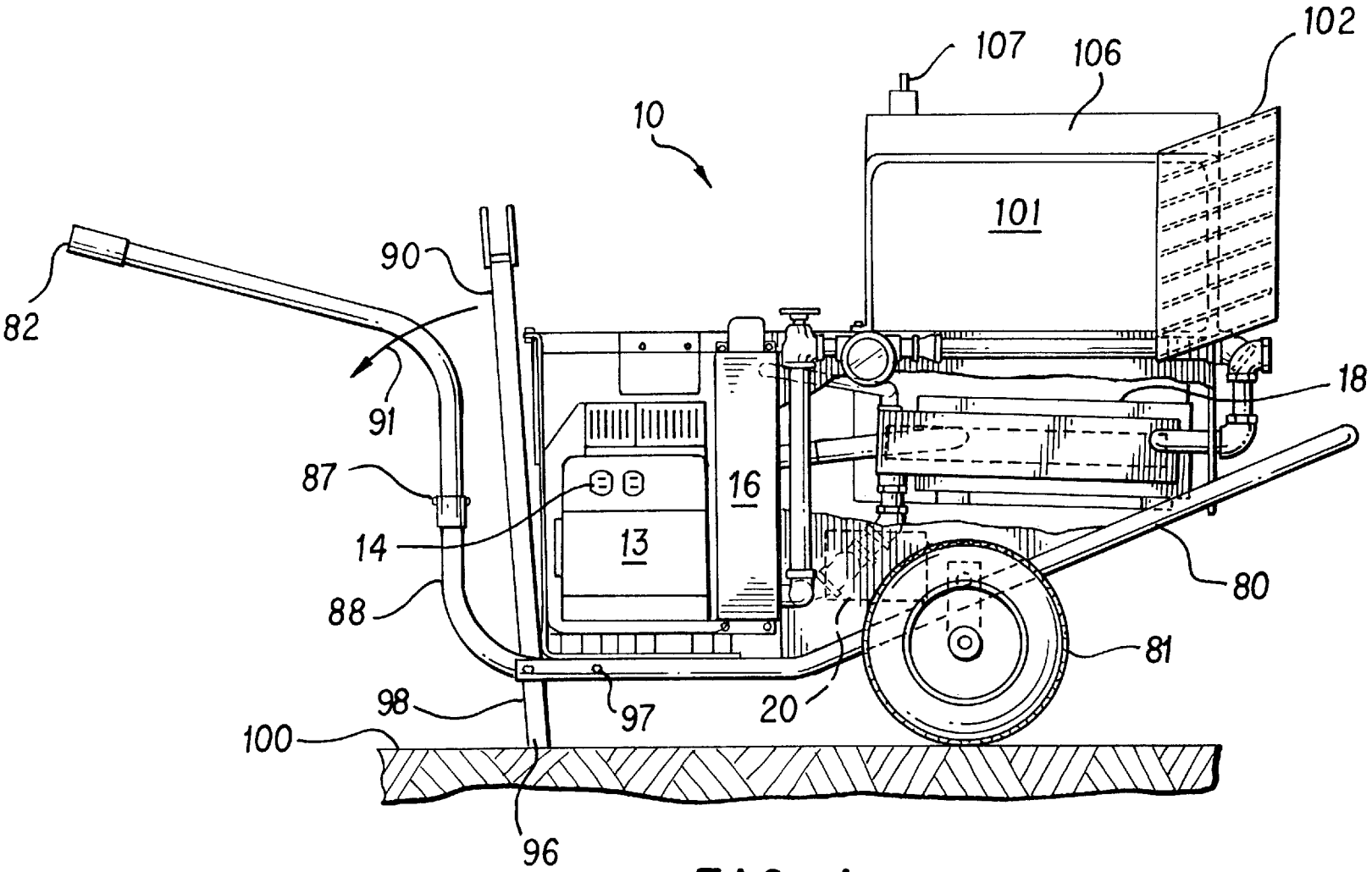
FIG. 1 is a side elevational view partially in section of the trailer of the ground heating system of the present invention.
Figure 2:
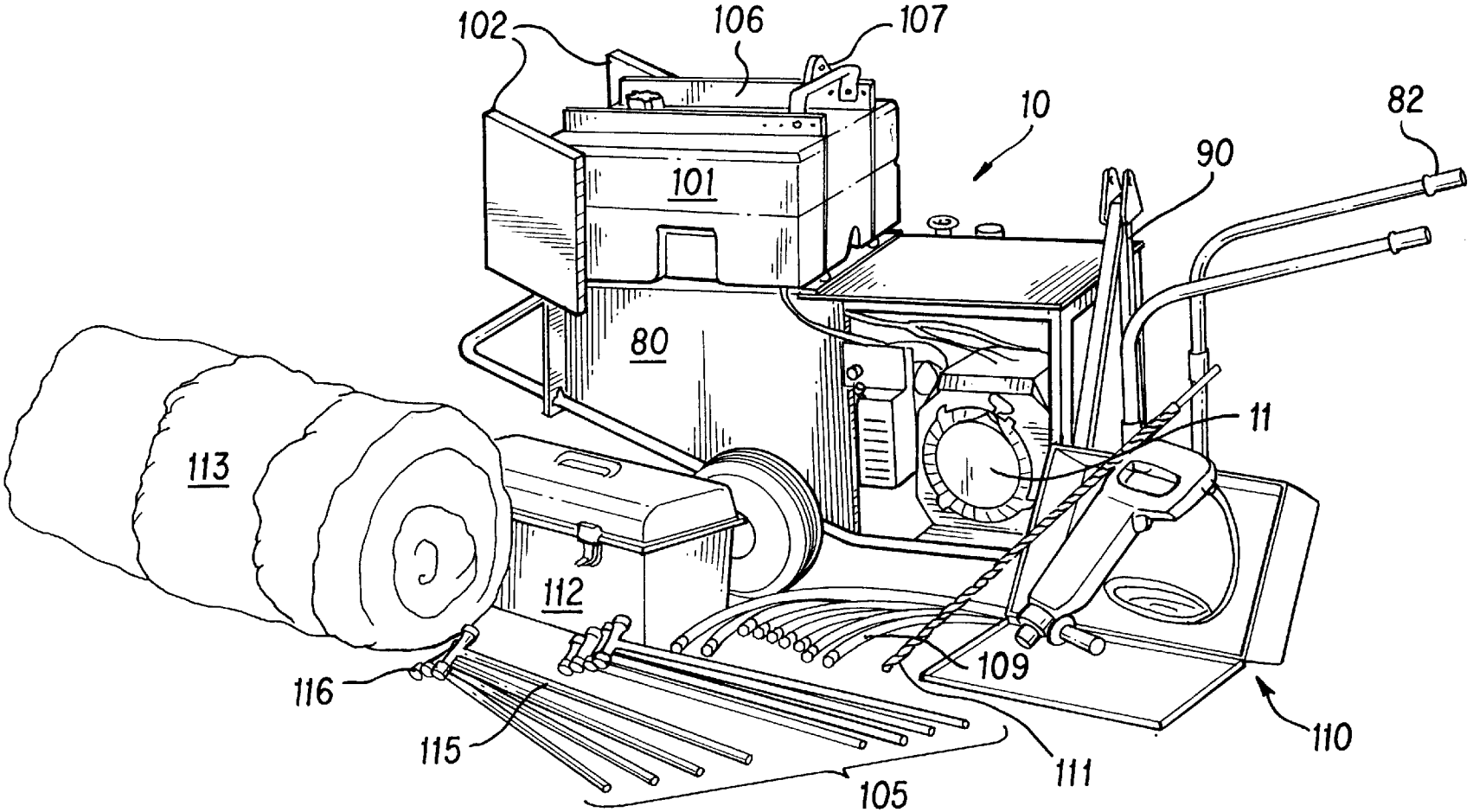
FIG. 2 is a perspective view of the ground heating system of the present invention.
Figure 3:
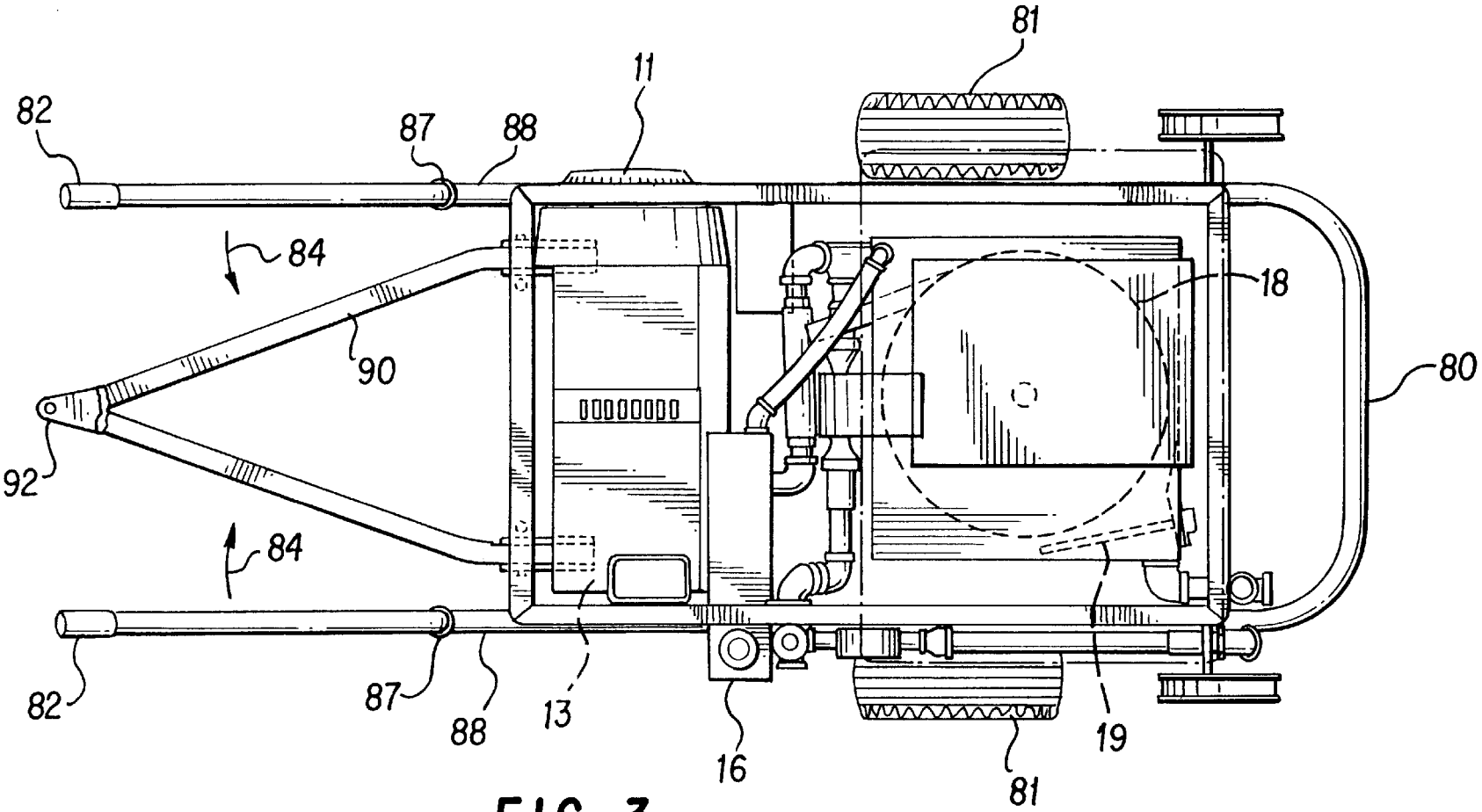
FIG. 3 is a top plan view partially in section of the trailer of the ground thawing system.

With reference now to FIGS. 1, 2, and 3, the mobile trailer of the ground heating system of the present invention is generally illustrated at 10. The ground heating system includes an internal combustion engine at 11 and an electric generator or alternator at 13. It should be understood that typically an electric alternator is provided at 13 for supplying alternating electric current. However, an electric generator could also be provided. The output of the generator could be switched to provide an alternating current output. In any case, hereinafter when an electric generator is referred to, it should be understood that such terminology is used to refer generally to either an electric generator or alternator.

Figure 4:
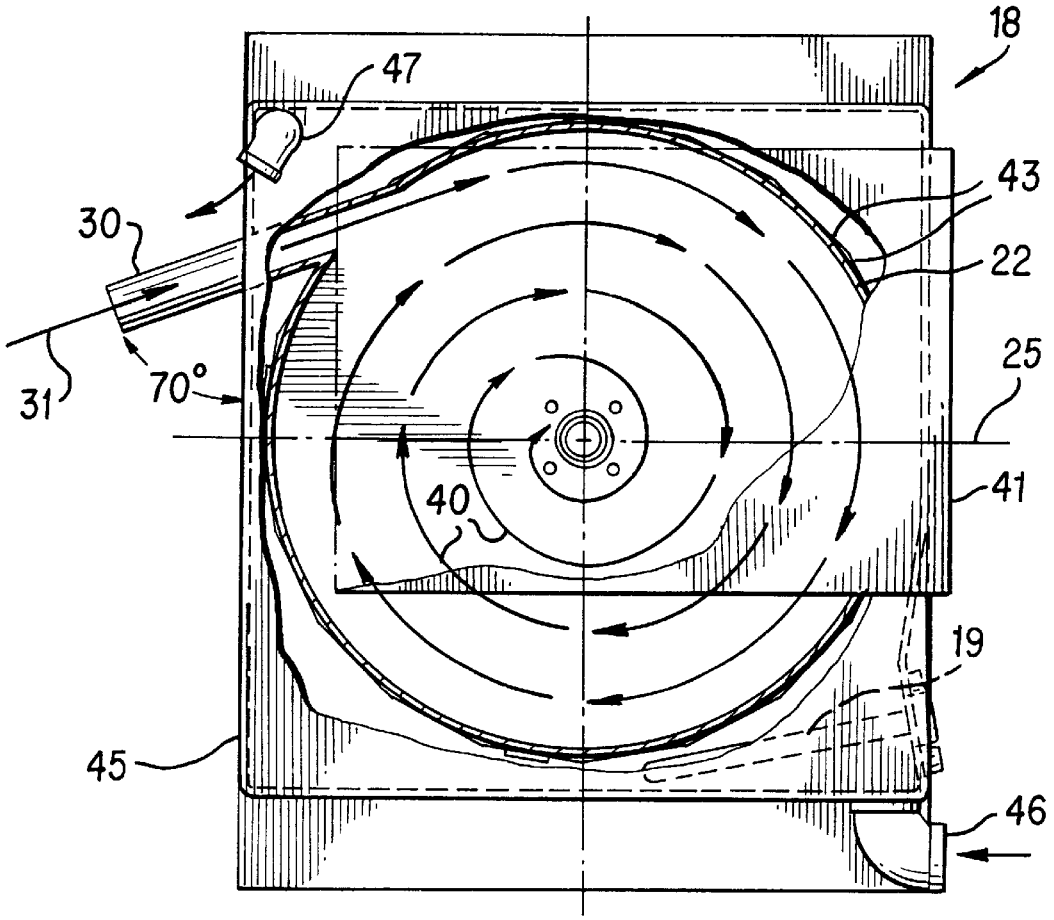
FIG. 4 is a top plan view partially in section of an exhaust gas heat exchanger.

With continued reference to FIGS. 1, 2, and 3, the electric generator 13 is driven by the shaft output of the internal combustion engine 11 for providing an electrical output at 14. A source of working fluid is provided in an expansion tank or working fluid reservoir 16. An exhaust gas heat exchanger is disposed at 18 for receiving exhaust gas from the internal combustion engine 11 and transferring heat from the exhaust gas to the working fluid. An electric heating element illustrated at 19 in FIGS. 3 and 4 is provided in the heat exchanger 18 for converting electrical output from the generator 13 into heat, which is then transferred to the working fluid. A pump is provided at 20 for moving the working fluid from the expansion tank 16 through the heat exchanger 18 and into a ground-engaging heat exchanger not illustrated in FIGS. 1 and 2. In the preferred embodiment, the pump 20 is driven by the electrical output of the generator 13. In this preferred embodiment, the internal combustion engine 11 is air cooled. However, in still other preferred embodiments, it may be desirable to use a water cooled internal combustion engine. In that case, the working fluid may be circulated in the water cooling jacket on the internal combustion engine, and the pump which circulates the working fluid through the ground heating system may be driven by the shaft output of the internal combustion engine.

Figure 5:
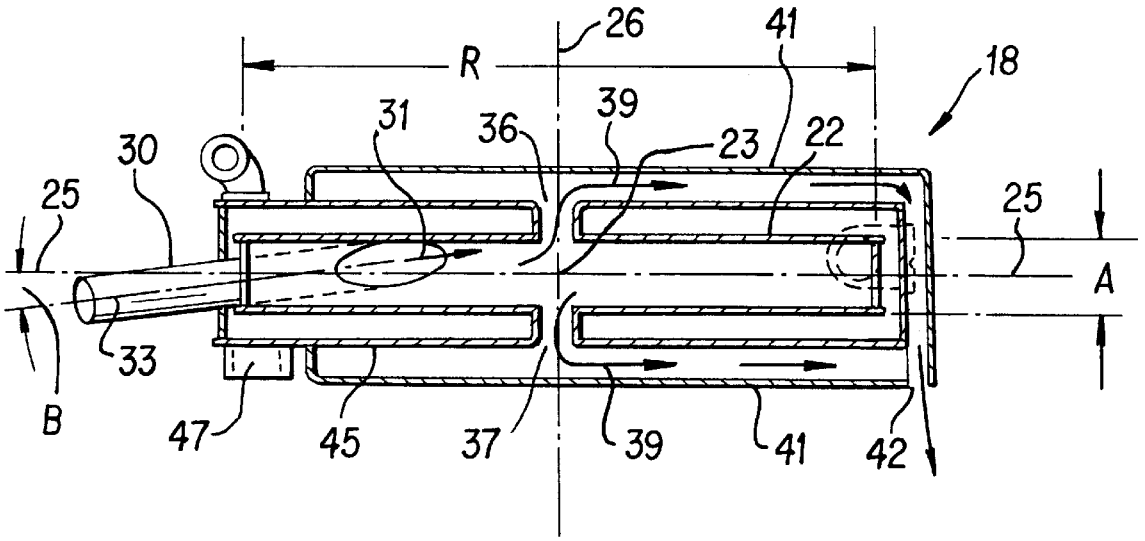
FIG. 5 is a side elevation view partially in section of the exhaust gas heat exchanger.

With specific reference now to FIGS. 4 and 5, it is illustrated that the exhaust gas heat exchanger 18 further comprises a disc-shaped chamber 22 for receiving exhaust gas from the internal combustion engine. The disc-shaped chamber 22 extends in axial and radial directions, which extend from the center 23 of the chamber 22. With particular reference to FIG. 5, the radial direction is defined by the centerline 25, while the axial direction is defined by the centerline 26. Also, as best illustrated in FIG. 5, the disc-shaped chamber 22 is provided with a radial dimension R, which is substantially larger than the axial dimension A. For example, a suitable ratio for the radial dimension R to the axial dimension A is seven to one.

With reference again to FIGS. 4 and 5, a tangential exhaust gas inlet is provided at 30. The tangential exhaust gas inlet 30 introduces hot exhaust gas from the internal combustion engine 11 along a tangent to the disc-shaped chamber 22 as best indicated by the arrows 31 in FIG. 4. As best illustrated in FIG. 5, the tangential exhaust gas inlet 30 is provided with a centerline defined by the axis 33 that intersects a plane containing the radial axis 25 at an acute angle B that is in a range of five to twenty-five degrees. In the present case, an angle B of approximately seven degrees is illustrated. The acute angle B provides eddies in the gas flow entering the chamber 22. These eddies improve the heat transfer in the chamber 22.

With continued reference to FIGS. 4 and 5, at least one, and preferably two, axially-disposed exhaust gas outlets are provided at 36 and 37. Whereby exhaust gas is directed into the disc-shaped chamber 22 through the tangential exhaust gas inlet 30, flowing in a decreasing or converging spiral-shaped flow path to the axially-disposed exhaust gas outlets 36 and 37. This spiral-shaped flow path is best illustrated in FIG. 4 by the arrows 40. Thus, with specific reference now again to both FIGS. 4 and 5, it is illustrated that the exhaust gas from the internal combustion engine first enters the disc-shaped chamber 22 tangentially in the direction of the arrows 31. The flow (which includes eddies) is then diverted to a circular or spiral path in the direction of the arrows 40. This spiral flow path 40 gradually converges to the center of the chamber 23, where the flow exits the opposing axially-disposed exhaust gas outlets in the directions of the arrows 39. An exhaust gas manifold 41 encompasses opposite sides of a fluid jacket 45 to duct the exhaust gas away from the heat exchanger to a discharge opening at 42.

The disc-shaped chamber 22 is formed from a plurality of axially-disposed steel segments, which are welded together or sandwiched between a top and a bottom steel plate. The segments, which are illustrated only in outline form at 43 in FIG. 4, are disposed to create the arcuate or circular outline illustrated for the disc-shaped chamber 22. The disc-shaped chamber 22 is surrounded by a working fluid or water jacket 45 which encompasses the disc-shaped chamber 22. The fluid jacket 45 is also formed from a welded steel construction. A working fluid inlet is provided at 46 and a working fluid main outlet is provided at 47. The working fluid inlet 46 and the working fluid main outlet 47 are disposed at opposing ends of the working fluid jacket 45. The electric heating element 19 is disposed inside of the fluid jacket 45 in direct fluid communication with the working fluid contained therein, proximate the working fluid inlet 46.

Figure 6:
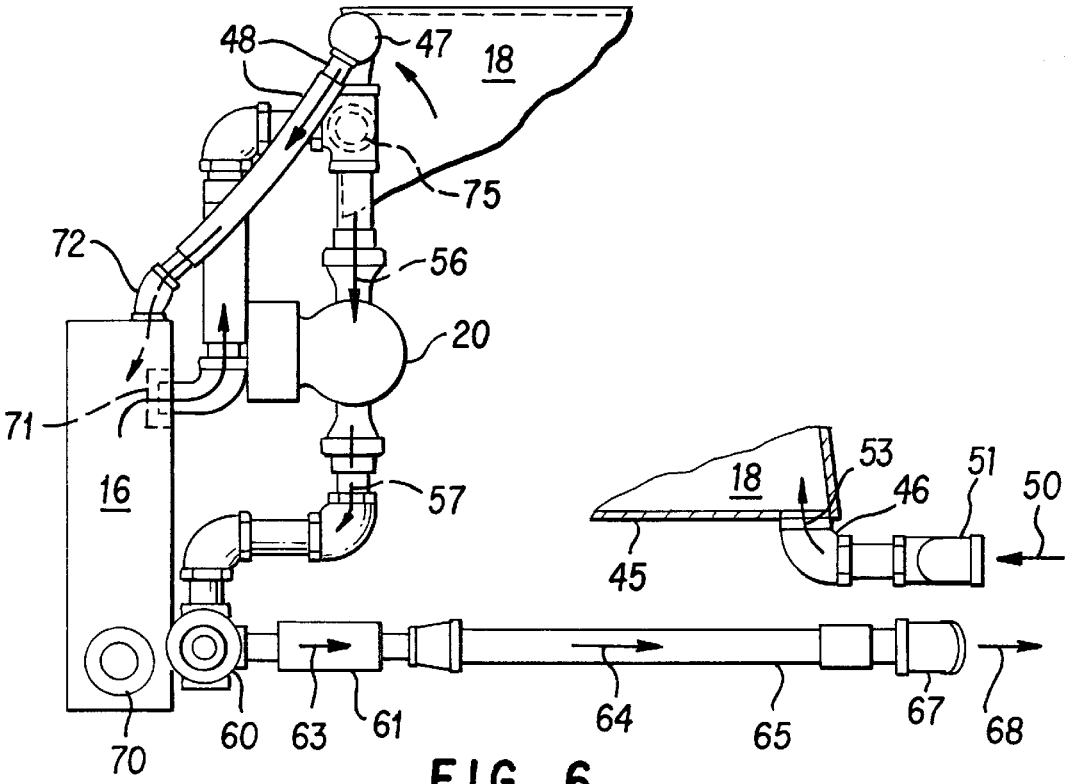
FIG. 6 is a top plan view of the working fluid flow path partially in section with some elements schematically illustrated.
Figure 7:
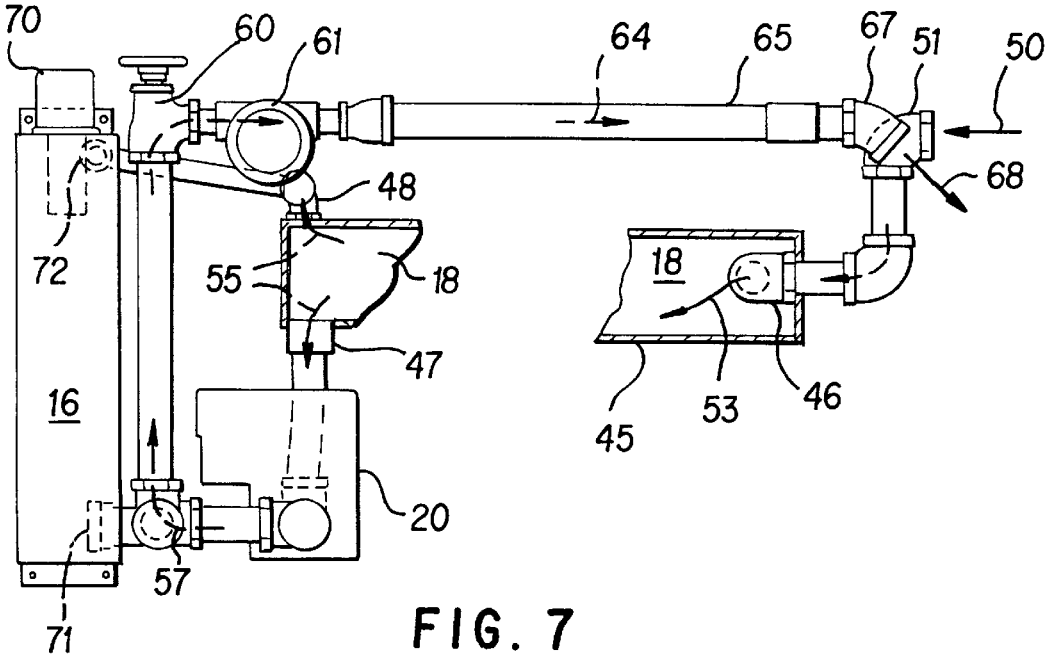
FIG. 7 is a side elevation view of the working fluid flow path partially in section with some elements schematically illustrated.

With reference now to FIGS. 6 and 7, the flow diagram for the working fluid is illustrated in further detail. The exhaust gas heat exchanger is schematically illustrated at 18. The working fluid inlet is disposed at 46, and the working fluid main outlet is disposed at 47. A fluid expansion and air elimination outlet is disposed at 48, which is positioned at the highest point of the working fluid jacket 45. The expansion chamber is disposed at 16 and the working fluid pump is disposed at 20. Working fluid returns from a ground-engaging heat exchanger in the direction of the arrows 50. A shut-off valve not illustrated herein is normally disposed on the fitting 51 to isolate the fluid in the system for transportation or to isolate the system when the ground-engaging heat exchangers are being assembled or moved. The working fluid enters the fluid jacket 45 of the heat exchanger 18 in the direction of the arrows 53. The fluid then exits the fluid jacket 45 through either the fluid main outlet 47 or the overflow 48 in the direction of the arrows 55. Fluid exiting the heat exchanger 18 through the main outlet 47 is fed directly to the pump 20 and flows generally in the direction of the arrow 56 in FIG. 6. Working fluid exits the pump 20 in the direction of the arrows 57. The working fluid flows through a T-fitting and thermometer 60 and then through a flow indicator 61 in the direction of the arrows 63. The flow continues in the direction of the arrows 64 within conduit 65 where it exits at fitting 67 in the direction of the arrows 68. Again, normally a shut-off valve is disposed on the fitting 67 to isolate the system during set-up and travel.

With reference again to FIGS. 6 and 7, the expansion tank 16 is provided with a vented cap 70, an expansion tank outlet at 71, and an overflow inlet at 72. The expansion tank 16 is provided to supply working fluid to the system and to provide an area within which the working fluid can expand as the system cycles thermally. For example, when the system is set-up, normally the hoses and the ground-engaging heat exchangers are already pre-charged with working fluid, but when the system is turned on and the temperature of the working fluid is raised, the working fluid will expand. Since fluids are substantially incompressible, the vented expansion tank 16 provides a volume within which the fluid can expand. The vented expansion tank 16 also serves to remove air from the working fluid. Fluid expansion and air removal is accommodated by flow through the expansion outlet 48 and into the expansion tank inlet 72. Because expansion tank 16 is vented, pump pressure is dissipated and the working fluid is allowed to expand, and air is separated from the working fluid. This makes the entire circulation system self-purging. The outlet 71 of the expansion tank is connected to the input side of the pump 20 through T-fitting 75, best illustrated in FIG. 6, so that the pump 20 is always provided with an ample supply of working fluid.

Figure 8:
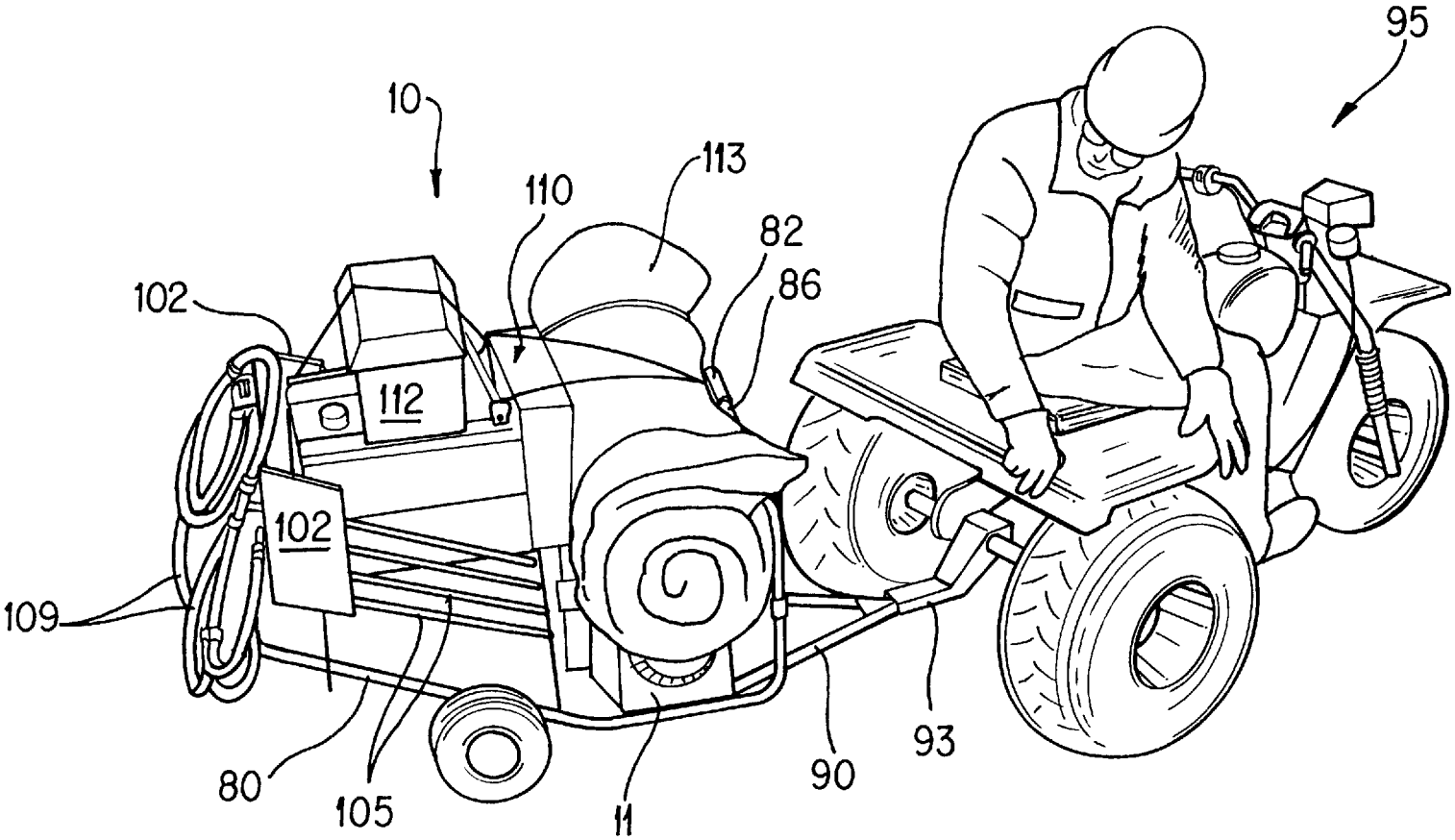
FIG. 8 is a perspective view of the mobile ground heating system of the present invention with all of the elements of the system stowed on the trailer and towed behind an automotive vehicle.

With specific reference now again to FIGS. 1 and 3, and general reference to the perspective views of the ground heating system illustrated in FIGS. 2, 8, 9 and 10, it is illustrated that the internal combustion engine 11, the electric generator 14, the working fluid expansion tank 16, the exhaust gas heat exchanger 18, and the electrical heating element 19, are all disposed on a mobile trailer 80, comprising a pair of ground-engaging wheels 81, a pair of hand grips 82 for manipulating the trailer 80 in a wheelbarrow-like fashion, and a drawbar 90 for towing the trailer behind a vehicle as illustrated in FIG. 8. When the system is towed with a vehicle, the hand grips 82 are pivoted inwardly in the direction of the arrows 84 in FIG. 3 to a stowed position, best illustrated at 86 in FIG. 8. Couplings are provided at 87 on a tubular frame 88 that extends to the hand grips 82. The couplings 87 are of a type which are used to alternately clamp the hand grips 82 in the position illustrated in FIG. 3, or loosened to permit rotation of the hand grips in the directions of the arrows 84 to the stowed position 86, best illustrated in FIG. 8. Upon disposing the handles in the stowed position as illustrated in FIG. 8, the couplings can be tightened or pinned again to make sure that the handles do not move.

To facilitate vehicle towing, the trailer 80 is provided with a pivotal drawbar 90. The drawbar 90 is alternately pivoted upward in the orientation illustrated in FIG. 1 to facilitate use of the trailer 80 in a wheelbarrow-like fashion, or is pivoted downward in the direction of the arrow 91 in FIG. 1 to the position illustrated in FIG. 3. In this deployed position, the drawbar 90 is used to attach the unit to a suitable hitch, such as the hitch 93 illustrated on the all-terrain vehicle (ATV) generally illustrated at 95 in FIG. 8. A bolt, pin, or other suitable mechanism is inserted through apertures 96 and 97 in the drawbar 90 and the frame of the trailer 80, respectively, to fix the drawbar 90 in the deployed position illustrated in FIG. 3. In the stowed position illustrated in FIG. 1, the ends of the drawbar, such as the end 98, extend downwardly below the frame of the trailer 80 to provide a ground-engaging contact with the support surface 100.

Operation

With specific reference now to FIGS. 1 and 2, it is illustrated that the ground thawing system further includes a fuel tank 101, a plurality of racks at 102 for holding a plurality of T-shaped probes which form part of the ground-engaging heat exchanger. With specific reference to FIG. 2, a plurality of the T-shaped ground-engaging probes are generally illustrated at 105. A support frame 106, which includes an eye at 107 is also provided for lifting the entire mobile ground thawing system trailer 10. As best illustrated in FIG. 2, the mobile ground thawing system 10 cooperates with a plurality of other elements, such as the T-shaped probes at 105, a plurality of hoses disposed at 109, an electric drill generally illustrated at 110, a long ground-engaging auger 111, a tool box 112, and a roll of insulating material 113.

Figure 10:
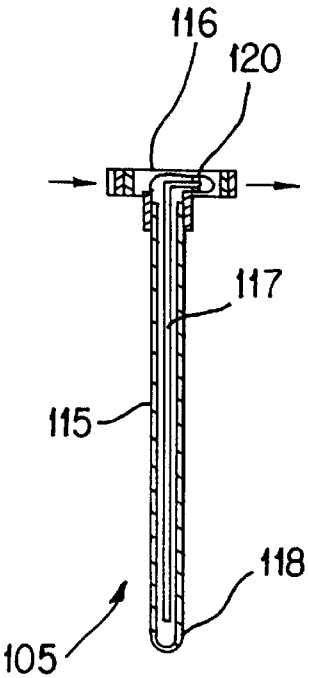
FIG. 10 is a side elevation view partially in section of one of the probes of a ground-engaging heat exchanger.

With reference now also to FIG. 10, the probes 105 each comprise a elongate body 115, which is inserted into the ground, and a T-shaped head 116 with couplings on opposing sides of the T-shaped head. The elongate bodies 115 of the ground-engaging probes further include an interior tube 117 which is colinear with the elongate body 115. This arrangement delivers hot, working fluid from the trailer 80 to the distal end 118 of the ground-engaging elongate portion 115 of the probe. The working fluid then travels back up to the head 116 of the probe through the interior tube 117, where it is discharged through the coupling on the opposite side of the head. In some embodiments of the probe, a baffle may be provided at 120 in the outlet side of the head 116 to proportion the amount of the heated working fluid that flows downward through the elongate body 115 of the probe. In some embodiments of the invention, both the probes 105 and the lengths of hose 109 are pre-charged with working fluid so that when the system is taken to the field, the hoses and the probes can be connected with quick-disconnect couplings without concern for filling of the system with working fluid.

With additional reference now to FIG. 8, it is illustrated that all of the elements illustrated in FIG. 2 can be loaded on the trailer 80 and towed with a suitable vehicle such as the ATV generally illustrated at 95. To facilitate towing, the handgrips 82 are pivoted inwardly to the stowed position illustrated at 86 in FIG. 8, and the drawbar 90 is pivoted downwardly to the deployed position illustrated in FIG. 8. The drawbar 90 is then connected with a pin or other suitable means to a trailer hitch 93 disposed on the rear of the ATV 95. The elongate probes 105 are disposed in racks 102, which are disposed on opposite sides of the trailer 80. The hoses 109 are connected via quick-disconnect couplings to the heads of the T-shaped heads of the elongate probes 105 and are coiled or otherwise suitably disposed on the back of the trailer 80. The rolled insulation is stowed at 113, the electric drill is stowed at 110, and the tool box is stowed at 112. Bungie cords or other suitable straps are used to secure many of the elements in place, such as the hoses 109, the insulation 113, and the boxes 110 and 112.

Figure 9:
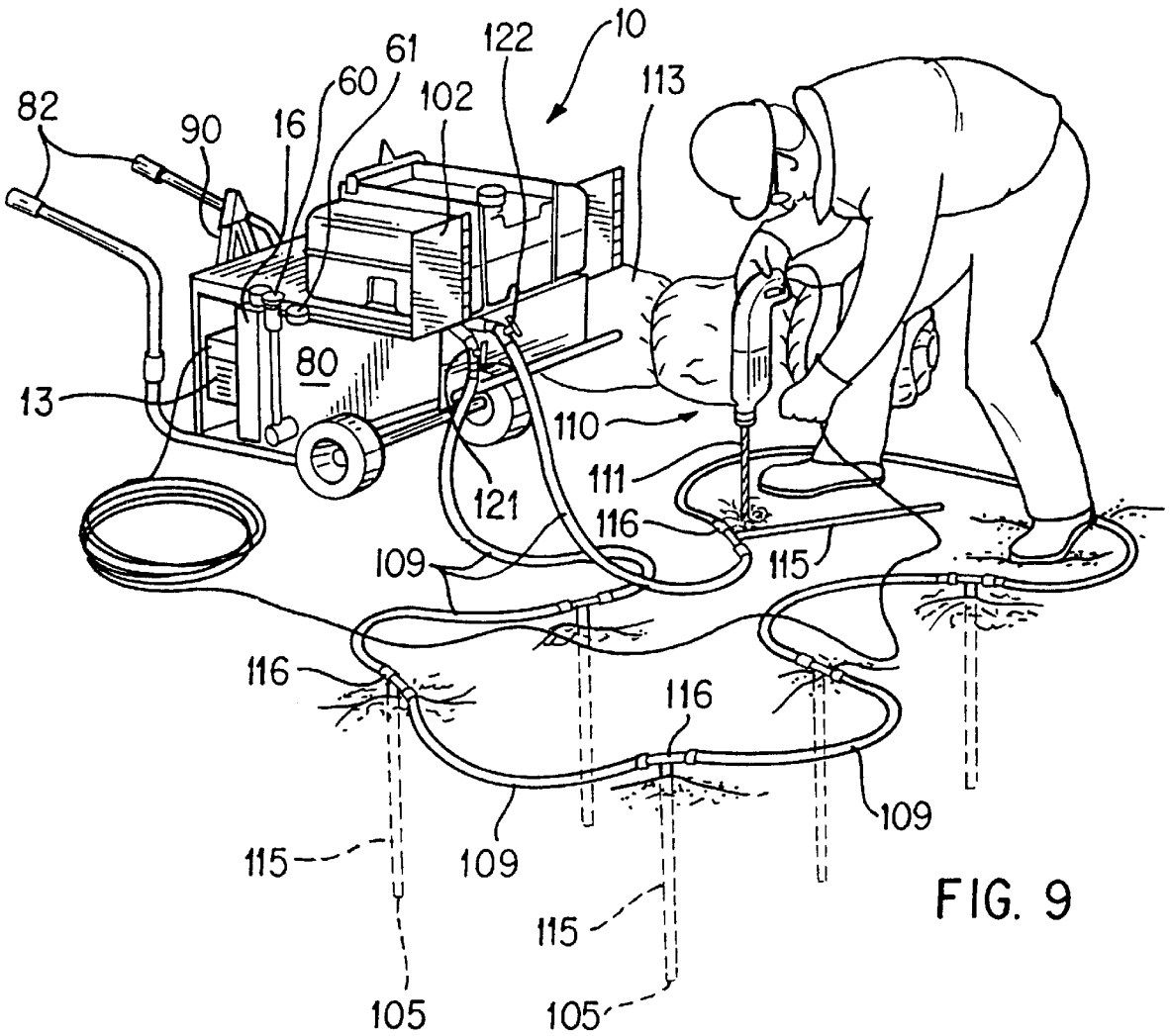
FIG. 9 is a perspective view of the mobile ground thawing system of the present invention during installation.

With reference now to FIG. 9, when a site is reached where it is desired to deploy the system and thaw the ground, the drawbar 90 is pivoted upward to the stowed position 90 and the handgrips 82 are pivoted outward to the position indicated in FIG. 9 so that the trailer 80 can be positioned in a wheelbarrow-like fashion at a desired location. The probes 105 are then withdrawn from the racks 102 and, if the lengths of hose 109 are not already connected, quick-disconnect couplings disposed on the lengths of hose 109 and opposite ends of the heads 116 of each of the probes 105 are used to assemble the unit as illustrated in FIG. 9. When assembled, the unit comprises a length of hose connected to an outlet valve 121, which extends serially to the inlet and outlet sides of each of the probes 105 and then back to an inlet valve disposed at 122 on the trailer 80. In cases where it is desirable to project heat deep into the ground, the user uses the electric drill generally illustrated at 110 with the auger 111 to drill a plurality of bore holes into the ground at a suitable spacing for insertion of the elongate probes 105. The operation of the motor generator set provides an ample supply of power for the electric drill, or other construction activity on the site, and heat is applied to the site by opening the valves 121 and 122, and starting the pump 20.

Figure 11:
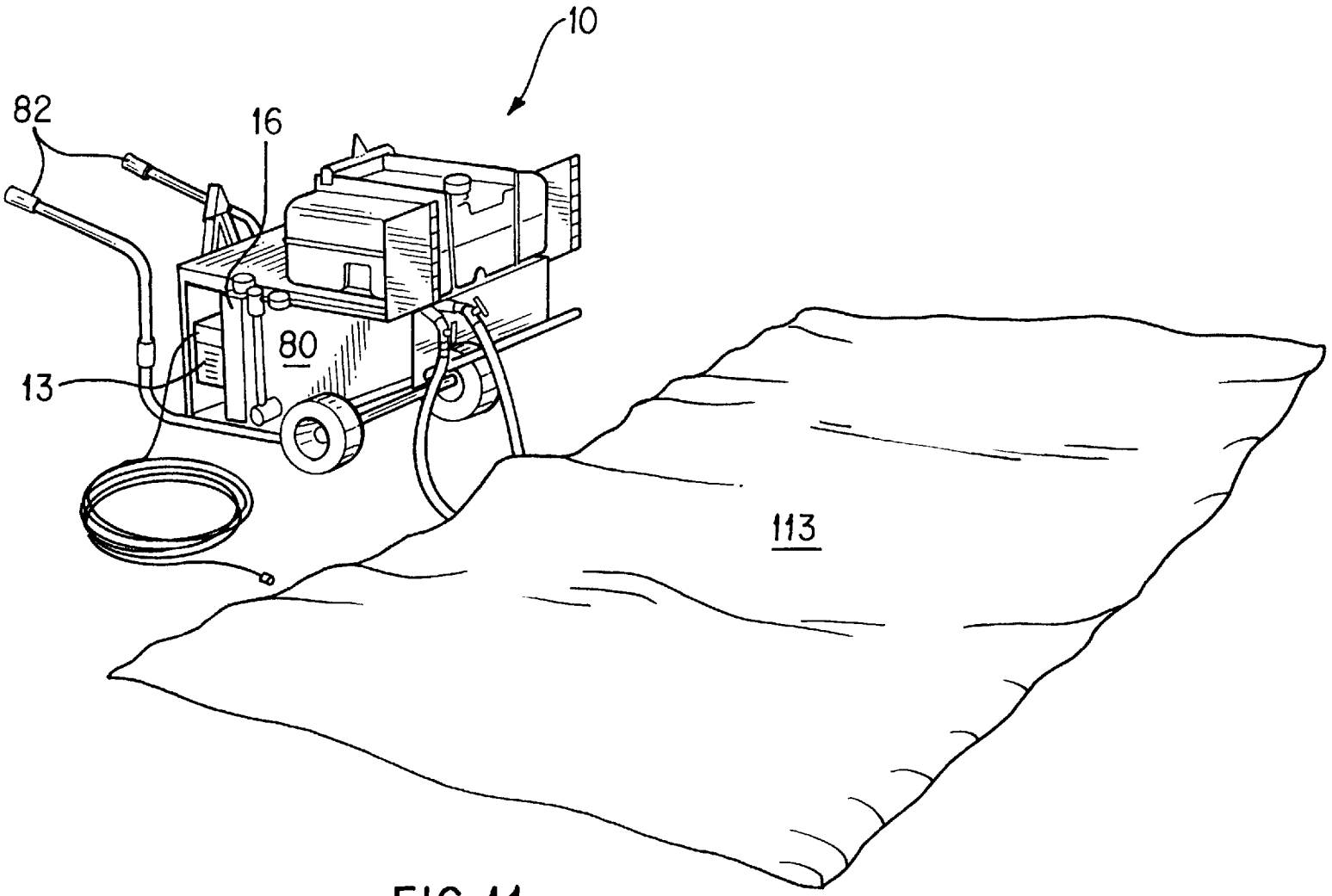
FIG. 11 is a perspective view of the mobile ground thawing system of the present invention fully installed on a site where it is desired to thaw the ground.

With reference now to FIG. 11, it is illustrated that a blanket of insulating material 113 may be placed over the hoses 109 and the probes 105 to concentrate the application of heat in the ground.

In other applications of the mobile ground thawing system of the present invention, the probes 105 may not be used in favor of a length of hose which is disposed under the insulating blanket 113 or under a suitable layer of soil, which is disposed over the hose. The probes 105 are preferred when it is desired to project heat to a greater depth into the ground. In other cases where it is desired to heat footings or a slab which is to be poured over an excavation, an elongate hose not illustrated herein would be disposed alongside the proposed footing or under the proposed slab so that the soil will remain thawed during the pouring of the footings or the slab and the mobile ground thawing system can be used later to heat the slab and/or the footings. This provides for the prompt and effective curing of freshly-poured concrete slabs and footings, as well as serving the additional purpose of providing a ready supply of dry heat to the structure, which is erected thereover.

The above description is considered to be that of the preferred embodiment only. While some modifications to the preferred embodiment are suggested above, it is contemplated that those skilled in the art will further modify the invention. It is desired to include within the scope of the present invention all such modifications of the invention that come within the proper scope of the appended claims.

The embodiments of the invention in which an exclusive property or privilege is claimed are defined as follows:

1. A ground heating system comprising:

an internal combustion engine providing a shaft output and an exhaust gas stream;

an electric generator driven by the shaft output of said internal combustion engine, said electric generator providing an electric output;

a working fluid for transferring heat to the ground;

a heat exchanger for receiving the exhaust gas stream and transferring heat from the exhaust gas stream to said working fluid, said heat exchanger having a disc-shaped chamber for receiving exhaust gas from said internal combustion engine, said chamber having an axial and a radial direction extending from a center of said chamber, and said chamber having a radial dimension larger than an axial dimension of said chamber; and an electric heating element for converting said electric output of said generator into heat and for transferring heat to said working fluid.

2. The ground heating system of claim 1 further comprising a pump for moving said working fluid, said pump being driven by one of the shaft output of said internal combustion engine and the electric output of said generator.

3. The ground heating system of claim 1 further comprising an engine jacket disposed on said internal combustion engine for transferring heat from said internal combustion engine to said working fluid.

4. The ground heating system of claim 3 wherein said heat exchanger further comprises a tangential exhaust gas inlet for introducing exhaust gas to said disc-shaped chamber.

5. The ground heating system of claim 4 wherein said tangential exhaust gas inlet is provided with a centerline that intersects a plane containing said radial direction at an acute angle.

6. The ground heating system of claim 5 wherein said acute angle is in a range of five to twenty-five degrees.

7. The ground heating system of claim 4 wherein said heat exchanger further comprises at least one axially disposed exhaust gas outlet whereby exhaust gas flows from said tangential exhaust gas inlet to said axially disposed exhaust gas outlet in a spiral-shaped flow path.

8. The ground heating system of claim 7 wherein said heat exchanger further comprises a first axially disposed exhaust gas outlet and a second axially disposed exhaust gas outlet, said first and second axially disposed exhaust gas outlets being juxtaposed on opposite sides of said disc-shaped chamber.

9. The ground heating system of claim 7 wherein said heat exchanger further comprises a working fluid jacket, said working fluid jacket encompassing said disc-shaped chamber and said jacket containing a substantial quantity of said working fluid for transferring heat from the exhaust gas contained in said disc-shaped chamber to said working fluid.

10. The ground heating system of claim 9 wherein said working fluid jacket further comprises a working fluid outlet and a working fluid inlet, said working fluid inlet and outlet being disposed on opposite sides of said working fluid jacket.

11. The ground heating system of claim 10 wherein said electric heating element is disposed in said working fluid jacket adjacent said working fluid inlet, said electric heating element extending into said jacket in direct communication with said working fluid contained therein.

12. The ground heating system of claim 1 wherein said internal combustion engine, said electric generator, said working fluid, said heat exchanger, and said electric heating element are disposed on a mobile trailer containing a pair of ground-engaging wheels; a pair of hand grips for manipulating said trailer in a wheelbarrow-like fashion; and a drawbar for towing said trailer with a vehicle.

13. The ground heating system of claim 12 wherein said trailer further comprises a frame upon which said drawbar is pivotally mounted, said drawbar further comprising at least one ground engaging leg which extends downwardly from said frame when said drawbar is pivoted upwardly into a stowed position, whereby said trailer is provided with a stable multiple-point contact with a supporting surface which levels the trailer to assure proper flow of the working fluid.

14. The ground heating system of claim 12 wherein said ground heating system further comprises an electric pump for moving said working fluid, said electric pump being disposed on said mobile trailer and said electric pump being driven by the output of said electric generator.

15. The ground heating system of claim 14 wherein said ground heating system further comprises a working fluid expansion chamber disposed on said mobile trailer for accommodating volumetric expansion and contraction of said working fluid and separating air therefrom.

16. The ground heating system of claim 15 wherein said ground heating system further comprises a means for transferring heat from said working fluid to the ground.

17. The ground heating system of claim 16 wherein said means for transferring heat comprises a working fluid conduit and a plurality of working fluid probes, said probes being particularly adapted for insertion into the ground.

18. The ground heating system of claim 17 wherein said trailer further comprises a probe rack for storage and transporting a plurality of said probes.

19. A ground heating system comprising:

an internal combustion engine providing a shaft output and a source of exhaust gas;

an electric generator driven by the shaft output of said internal combustion engine; said electric generator providing an electric output;

a disc-shaped chamber for receiving said exhaust gas and waste heat contained therein from said internal combustion engine, said chamber having an axial and a radial direction extending from a center of said chamber;

a tangential exhaust gas inlet disposed on said disc-shaped chamber for introducing said exhaust gas to said chamber;

at least one axial exhaust gas inlet disposed on said disc-shaped chamber, whereby exhaust gas flows from said tangential inlet to said axial outlet in a converging, spiral-shaped flow path in a radial direction;

a source of a working fluid for transferring heat to the ground;

a pump for transferring said working fluid;

a working fluid jacket, said jacket encompassing said disc-shaped chamber for drawing waste heat from said exhaust gas, said jacket further comprising a working fluid outlet and a working fluid inlet disposed on opposite sides of said jacket; and an electric heating element disposed on said jacket adjacent said working fluid outlet and in contact with said working fluid, said electric output of said generator being applied to said heating element for converting the shaft output of said internal combustion engine into heat which is transferred to said working fluid.

20. A mobile ground heating system comprising:

a mobile vehicle having at least one pair of ground engaging wheels;

an internal combustion engine disposed on said vehicle for providing a shaft output and a source of hot exhaust gas containing waste heat;

an electric generator disposed on said vehicle and driven by said shaft output of said internal combustion engine, said generator providing an electric output;

a disc-shaped chamber disposed on said vehicle for receiving said exhaust gas and the waste heat contained therein from said internal combustion engine, said chamber having an axial and a radial direction extending from a center of said chamber;

a tangential exhaust gas inlet disposed on said disc-shaped chamber for introducing said exhaust gas to said chamber;

at least one axial exhaust gas inlet disposed on said disc-shaped chamber, whereby exhaust gas flows from said tangential inlet to said axial outlet in a converging, spiral-shaped flow path in a radial direction;

a source of a working fluid for transferring heat;

a ground engaging heat exchanger means for receiving said working fluid and transferring heat to the ground;

a working fluid jacket, said jacket encompassing said disc-shaped chamber for drawing waste heat from said exhaust gas; and an electric pump driven by said electric output of said generator for transferring said working fluid from said jacket to said ground engaging heat exchanger means and back to said jacket;

an electric heating element disposed on said jacket in contact with said working fluid, said electric output of said generator being applied to said heating element for converting the shaft output of said internal combustion engine into heat which is transferred to said working fluid.

21. A ground heating system comprising:

an internal combustion engine providing a shaft output and a source of exhaust gas;

an electric generator driven by the shaft output of said internal combustion engine; said electric generator providing an electric output;

a disc-shaped chamber for receiving said exhaust gas and waste heat contained therein from said internal combustion engine, said chamber having an axial and a radial direction extending from a center of said chamber;

a tangential exhaust gas inlet disposed on said disc-shaped chamber for introducing said exhaust gas to said chamber;

at least one axial exhaust gas inlet disposed on said disc-shaped chamber, whereby exhaust gas flows from said tangential inlet to said axial outlet in a converging, spiral-shaped flow path in a radial direction;

a source of a working fluid for transferring heat to the ground;

a pump for transferring said working fluid; and a working fluid jacket, said jacket encompassing said disc-shaped chamber for drawing waste heat from said exhaust gas.

* * * * *